US007722207B2

(12) United States Patent
Bennette

(10) Patent No.: US 7,722,207 B2
(45) Date of Patent: May 25, 2010

(54) BALUSTER LIGHTING ASSEMBLY AND METHOD

(75) Inventor: Richard G Bennette, Boerne, TX (US)

(73) Assignee: Creative Industries, LLC, San Antonio, TX (US)

( * ) Notice: Subject to any disclaimer, the term of this patent is extended or adjusted under 35 U.S.C. 154(b) by 96 days.

(21) Appl. No.: 11/809,744

(22) Filed: Jun. 1, 2007

(65) Prior Publication Data

US 2008/0298049 A1 Dec. 4, 2008

(51) Int. Cl.
*F21S 8/00* (2006.01)

(52) U.S. Cl. ..... 362/146; 362/145; 362/152; 362/431; 362/576; 359/591; 52/28; 52/832

(58) Field of Classification Search ..... 362/145–147, 362/223, 576, 151, 152, 431, 800, 217.04, 362/217.1, 217.14, 222; 359/591; 52/28, 52/832

See application file for complete search history.

(56) References Cited

U.S. PATENT DOCUMENTS

| | | | | | |
|---|---|---|---|---|---|
| 541,337 | A | * | 6/1895 | Sieburg | 362/145 |
| 785,695 | A | * | 3/1905 | Munns | 362/145 |
| 4,152,624 | A | | 5/1979 | Knaebel | |
| 4,190,976 | A | | 3/1980 | Hurt | |
| 4,204,271 | A | * | 5/1980 | Braly | 362/145 |
| 4,574,337 | A | | 3/1986 | Poppenheimer | |
| 4,597,033 | A | | 6/1986 | Meggs | |
| 4,744,014 | A | | 5/1988 | Harris | |
| 4,758,934 | A | | 7/1988 | von Kohorn | |
| 5,036,442 | A | | 7/1991 | Brown | |
| 5,045,981 | A | | 9/1991 | Nagano | |
| 5,068,773 | A | | 11/1991 | Toth | |
| 5,083,192 | A | | 1/1992 | Rzeznik | |
| 5,130,909 | A | | 7/1992 | Gross | |
| 5,211,469 | A | | 5/1993 | Matthias | |
| 5,222,799 | A | | 6/1993 | Sears | |
| 5,264,997 | A | | 11/1993 | Hutchisson | |
| 5,349,509 | A | | 9/1994 | Klug | |
| 5,450,299 | A | | 9/1995 | Lepre | |
| 5,513,081 | A | * | 4/1996 | Byers | 362/145 |
| 5,632,551 | A | | 5/1997 | Roney | |
| 5,701,236 | A | | 12/1997 | Viviano | |
| 5,771,617 | A | | 6/1998 | Baker | |
| 5,779,228 | A | | 7/1998 | Hansen | |
| 5,829,865 | A | | 11/1998 | Ahroni | |
| 5,842,779 | A | | 12/1998 | Siebert | |
| 5,876,109 | A | | 3/1999 | Scalco | |
| 5,927,845 | A | | 7/1999 | Gustafson | |
| 6,069,447 | A | | 5/2000 | Vilanilam | |
| 6,135,621 | A | | 10/2000 | Bach | |

(Continued)

*Primary Examiner*—Sandra L O'Shea
*Assistant Examiner*—Mary Zettl
(74) *Attorney, Agent, or Firm*—Kelly Lowry & Kelley, LLP

(57) ABSTRACT

A baluster lighting assembly and method using illuminated intermediate baluster members in which balusters or pickets can be adjustably spaced along a power cord. A plurality of light sources mounted in each of a plurality of balusters or pickets are electrically connected to a power cable through connector housings mounted in each of the balusters or pickets. Each connector housing includes pierce connectors for penetrating the insulation of the power cable and coming into electrical, non-shorting contact with the power cable's live and ground wires along any selected location of the power cable.

29 Claims, 5 Drawing Sheets

U.S. PATENT DOCUMENTS

| | | | | |
|---|---|---|---|---|
| 6,179,644 | B1 * | 1/2001 | Adams et al. | 439/387 |
| 6,241,361 | B1 | 6/2001 | Thrasher | |
| 6,265,834 | B1 | 7/2001 | Lin | |
| 6,363,680 | B1 * | 4/2002 | Erwin | 52/832 |
| 6,415,732 | B1 | 7/2002 | Delorenzo | |
| 6,505,950 | B1 * | 1/2003 | Natoli et al. | 362/146 |
| 6,676,278 | B2 | 1/2004 | Striebel | |
| 7,052,170 | B2 | 5/2006 | Striebel | |
| 7,168,843 | B2 | 1/2007 | Striebel | |
| 2004/0184263 | A1 * | 9/2004 | Patti | 362/145 |
| 2005/0030765 | A1 * | 2/2005 | Southard et al. | 362/559 |
| 2005/0141225 | A1 * | 6/2005 | Striebel | 362/382 |
| 2007/0258232 | A1 * | 11/2007 | Prince et al. | 362/146 |

* cited by examiner

BALUSTER LIGHTING ASSEMBLY AND METHOD

FIELD OF THE INVENTION

The invention relates to balusters or pickets that support the railings of balconies, decks, stairs, and fences and more particularly, to lighting assemblies for use with balusters and picket caps and a method of lighting a baluster.

BACKGROUND OF THE INVENTION

A baluster is a vertical picket (sometimes called a guard or spindle or picket) or molded shaft, typically made of stone, metal, plastic or wood, that supports the top rail of a balcony, deck, or fence, the handrail of a staircase, or even the coping of a parapet. Balusters are frequently made with decorative and ornamental features. The complete system of balusters and rails is often referred to as a "balustrade."

Lighting has been used in connection with balusters. One known way of lighting balusters or pickets has been to illuminate them with a series of external lights at the top of exterior of the balusters or pickets. Another known way of lighting balusters or pickets has been to illuminate them with an external spot light. There is a need for baluster lighting assemblies with illuminated center baluster members.

There is also a need for an easy-to-assemble baluster or picket lighting assembly in which the balusters or pickets can be adjustably spaced along a power cable.

SUMMARY OF THE INVENTION

This invention is directed to, but not limited by, one or more of the following objects, separately or in combination: (1) baluster lighting assemblies with illuminated center baluster members; (2) a baluster or picket lighting assembly in which balusters or pickets can be adjustably spaced along a power cord; and a method of lighting a baluster or picket lighting assembly. The baluster or picket lighting assembly comprises a plurality of balusters or pickets; a plurality of light sources operable to be mounted in each of the balusters or pickets; an insulated power cable operable to be strung between the balusters or pickets to supply power to the light sources; a plurality of connector housings sized and shaped for attachment to or insertion into the balusters or pickets, each connector housing having pierce connectors for penetrating the insulation of a power cable and coming into electrical, non-shorting contact with the live and ground wires; and wires connecting the pierce connectors of each connector housing to a corresponding light source.

These and other features of the present invention will be better understood in conjunction with the drawings and the detailed description below. It should be noted that the invention is broad enough to encompass many different embodiments, including embodiments that do not appropriate all, some, or any of these cited objects. The summary set forth herein is not intended to limit the claims herein, the scope of which is set forth by the claim language itself.

DETAILED DESCRIPTION

Figure 1:
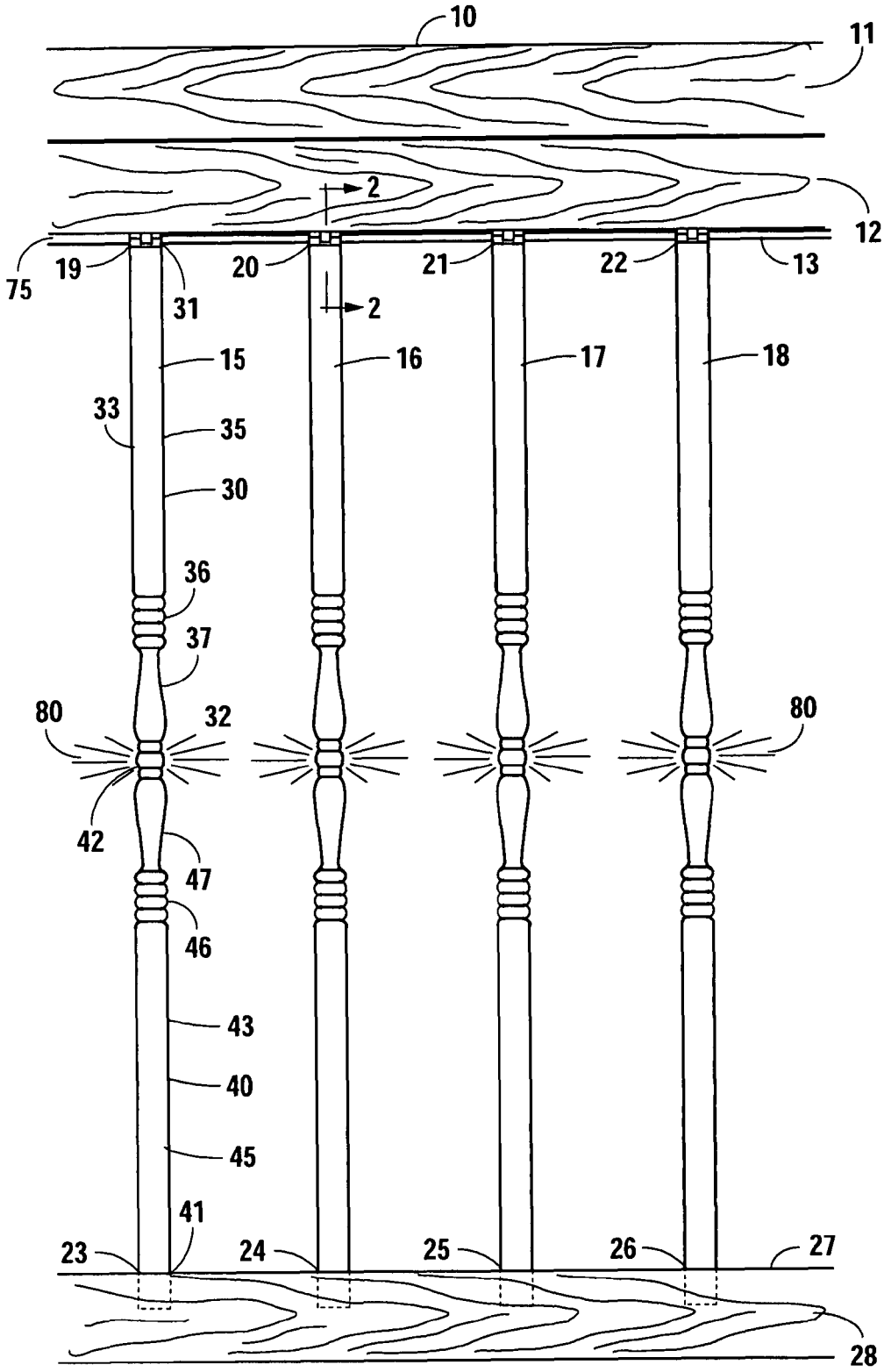
FIG. 1 illustrates one embodiment of a balustrade assembly designed according to the principles of this invention.

Referring to FIG. 1 there is show an embodiment of the invention. The balustrade assembly 10 comprises a plurality of baluster assemblies 15, 16, 17 and 18 that connect a top rail 12 to a base rail or shoerail 28 (or alternatively to a floor or stair tread).

The plurality of baluster assemblies 15, 16, 17 and 18 are secured, at their upper ends 19, 20, 21 and 22, to a lower flat baluster mounting surface 13 of the top rail 12. The upper ends 19, 20, 21 and 22 are round in cross section but could be any desired decorative shape. The lower ends 23, 24, 25 and 26 of the baluster assemblies 15, 16, 17 and 18 are secured to an upper surface 27 of the base rail 28.

The balustrade assembly 10 optionally includes a horizontal cap member 11 that is secured to and mounted on top of the horizontal top rail 12. Cap member 11 and top rail 12 may be constructed of wood or other available construction materials, and may take any shape used for rails and banisters. Likewise, the base rail 28 may be constructed of wood or other available construction materials.

In one embodiment, all of the baluster assemblies 15, 16, 17 and 18 have identical shapes and sizes. The baluster assembly 15 includes a hollow upper baluster section 30. The upper baluster section 30 includes upper end portion 31 and lower end portion 32. A passageway 33 having a preferably reflective interior surface 34 (FIG. 2) is formed in the upper baluster section 30 and extends the full length of the baluster section 30 for passage of light there through. The baluster section 30 may be made of extruded aluminum, thereby providing a reflective passageway 33 that facilitates the passage of light from one end of the baluster section 30 to the other end of the baluster section 30. Alternatively the interior surface 34 may be coated with a reflective coating to facilitate the passage of light there through. The baluster section 30 may have a rounded exterior surface 35 beginning at the upper end 19 that changes to decorative portion 36 that changes to a spindle shaped round portion 37 at the lower end 32. The embodiment shown is merely one of the many number of decorative shaped balusters that can be used. While the baluster section 30 is shown as round it could also be made square or some other decorative shape subject to manufacturing and economic limitations.

The baluster assembly 15 includes a lower baluster section 40 that may have the same construction as the upper baluster section 30 such that it is merely an inverted version of the upper baluster section 30. The baluster section 40 includes lower end portion 41 and upper end portion 42. A passageway 43 having a preferably reflective interior surface 44 is formed in the upper baluster section 40 and extends the full length of the baluster section 40 for passage of light there through. Like baluster section 30, baluster section 40 may be made of extruded aluminum, thereby providing a reflective passageway 33 that facilitates the passage of light from one end of the baluster section 30 to the other end of the baluster section 30. Alternatively, the interior surface 44 may be coated with a reflective coating to facilitate the passage of light there through. The baluster section 40 may have a rounded exterior surface 45 beginning at the lower end 23 that changes to decorative portion 46 that changes to a spindle shaped round portion 47 at the upper end 42. The embodiment shown is merely one of the many number of decorative shaped balusters that can be used. While the baluster section 40 is shown as round it could also be made square or some other decorative shape subject to manufacturing and economic limitations.

Although shown as being oriented vertically, the balusters could also be mounted at an angle to the horizontal. Also, although the baluster assemblies are typically are mounted between two rails, they could be mounted in a wall that had the rails framing an opening in the wall, or they could be mounted between an upper rail and a floor, the treads of a staircase, or a concrete, brick, or rock footing.

Referring to FIGS. 2-7 there is shown the detailed construction of connector housings 50 that are used to connect the baluster sections 30 and 40 to the upper and lower rails 12 and 28. Identical connector housings 50, at least one of which includes an LED light member, are inserted into the end portions 31 and 41.

Each housing 50 includes an insertion portion 51 which may be unthreaded and which inserts into the passageways 33 and 43 and tightly fits into the end of the baluster sections 30 and 40 for attaching the baluster sections to the upper rail 12 and base rail 28. For round baluster passageways 33, the insertion portion 51 is round and includes a generally flat end surface 52. At the other end of the insertion portion 51 is a flanged base portion 53 that mates with a round cap member 56.

Figure 2:
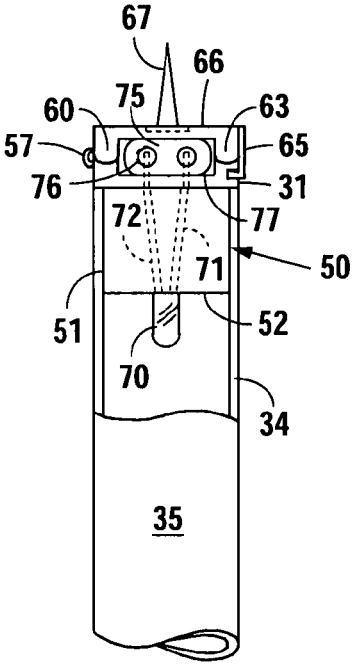
FIG. 2 illustrates one embodiment of a connector housing incorporating an LED and inserted into a baluster section, for connecting the baluster section to a rail.
Figure 3:
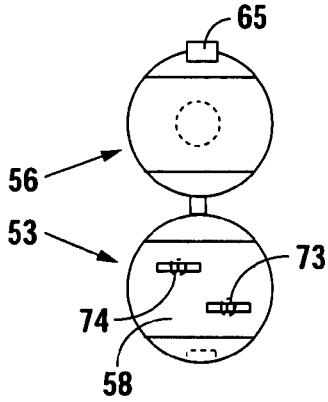
FIG. 3 is a top view of the connector housing of FIG. 2, but, unlike FIG. 2, showing the connector housing's flanged based portion and hingedly-connected cap member in an open position, and also depicting pierce connectors for piercing the hot and ground wires of an electrical cable protruding upwardly from the upper surface of the flanged base portion.
Figure 4:
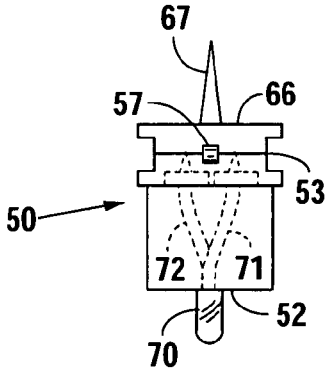
FIG. 4 is a rear-facing view of the connector housing of FIG. 2, with the cap member in a closed position.
Figure 5:
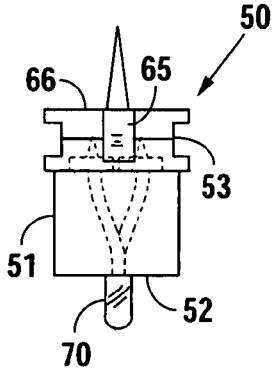
FIG. 5 is a forward-facing view of the connector housing of FIG. 4.
Figure 6:
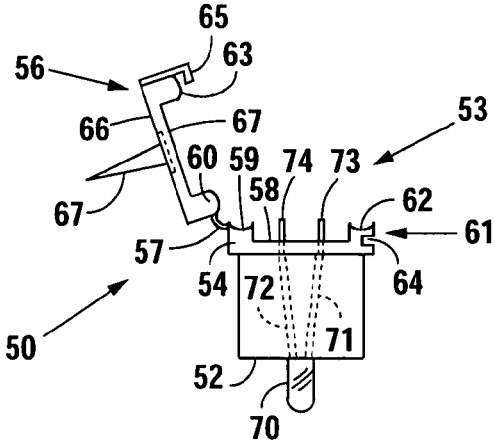
FIG. 6 is a side view of the connector housing of FIG. 2, illustrating the cooperating relationship between the flanged base portion and the hingedly-connected cap member, with the cap member depicted in the open position.
Figure 7:
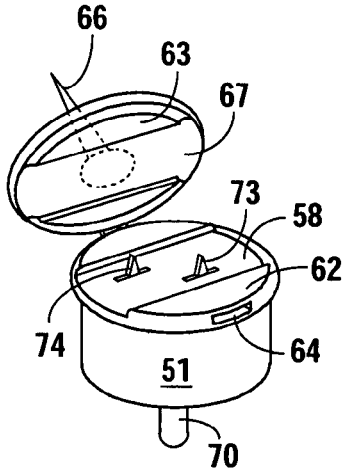
FIG. 7 is a perspective view of the connector housing of FIG. 2, depicting the cap member in an open position and illustrating, especially, pierce connectors for piercing the hot and ground wires of an electrical cable.

As shown in FIG. 6, the round cap member 56, having upper surface 66 and lower surface 67, is connected to a hinge mount portion 54 on the flanged base portion 53 by a flexible hinge member 57 to allow the cap member 56 to be hinged away from the flanged base portion 53. The hinge mount portion 54 extends above the upper surface 58 of the flanged base portion 53 and has a concave surface that mates with a convex surface portion 60 of the cap member 56 that extends below the lower surface 67 of the cap member 56. The other side of the flanged base portion 53, opposite the hinge mount portion 54, has a connector portion 61 that has a concave surface 62 spaced above the surface 58 that mates with the convex surface portion 63 on the cap member 56 that also extends below the lower surface 67 of the cap member 56. A recess or notch 64 is provided for releasably connecting with the L-shaped flexible catch 65 that locks with the notch 64, as shown in FIG. 2.

Attached to the upper surface 66 of the cap 56 is a screw member 67 that can be screwed into the upper rail 12 and base rail 28. Alternatively, the screw member 67 could be replaced with any other suitable attaching means, including, for example, a pin member that can be inserted into a mating opening in the rails.

In one embodiment of a connector housing 50, a LED light 70 is molded into the connector housing 50 and includes power supplying wires 71 and 72 that are connected to pierce connectors 73 and 74 that extend above the surface 58. For simplicity, the drawings depict each pierce connector 73 and 74 as having a single triangular blade. But each pierce connector 73 and 74 may take the shape of a tiny contact jaw, as are typically found in insulation displacement connectors. The LED light is operable to be connected, as shown in FIG. 2, to an electrical supply cable 75 having wires 76 and 77. In this manner, consumers can adjustably space the lighted baluster assemblies along the wire in a manner that meets their construction requirements. Furthermore, the cable 75 can be placed inconspicuously, and with minimal cable slack between balusters, along a bottom surface of (or, more preferably, recessed within a groove along the bottom surface of) the top rail 12.

Preferably, the electrical supply cable 75 is a ribbon cable, with two untwisted insulated wires 76 and 77 running parallel together, that match the pierce connectors 73 and 74. Surfaces 58 and 67 are sized, spaced, and configured to press-fit the cable 75 onto the pierce connectors 73 and 74 and to tightly enclose the cable 75. Although not shown in the drawings, surface 67 may have scalloped grooves to further facilitate the press-fitting of the cable 75 onto the pierce connectors 73 and 74. In this manner, the cable 75 is tightly held in place with the pierce connectors 73 and 74 piercing the cable 75 and making electrical connection with the wires 76 and 77 to supply electricity to light the LED bulb 70.

In other embodiments of the connector housing 50, the LED light 70, power supplying wires 71 and 72, and pierce connectors 73 and 74 are absent. In some embodiments of the balustrade assembly 10, connector housings 50 with LEDs are provided for the upper baluster sections 30, while connector housings 50 without LEDs are provided for the lower baluster sections 40. Except for the LEDs 70, wires 71 and 72, and pierce connectors 73 and 74, the connector housings 50 for the upper and lower baluster sections 30 and 40 may be the same. In other embodiments of the balustrade assembly 10, identical connector housings 50 with LEDs are provided for both the upper and the lower baluster sections 30 and 40.

Figure 8:
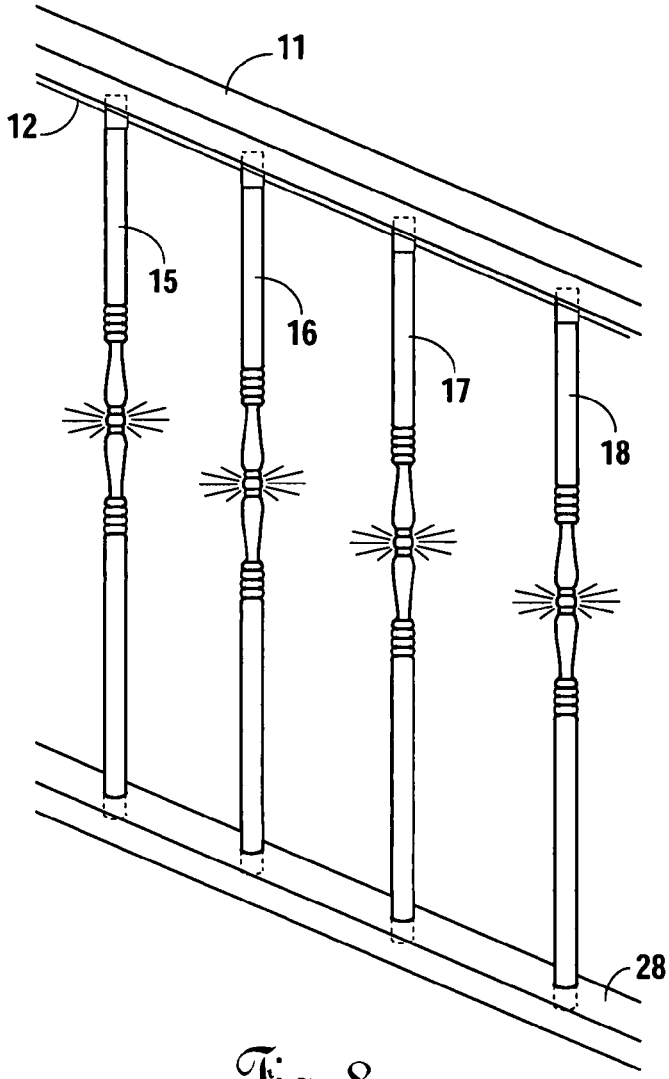
FIG. 8 illustrates a staircase embodiment of the balustrade assembly.

As shown in FIG. 2, the light from the LED bulb 70 illuminates the hollow interior passageway 33 of the baluster section, which channels the light to illuminate the center baluster member 80 that connects the baluster sections 30 and 40 a shown in FIG. 8.

Figure 9:
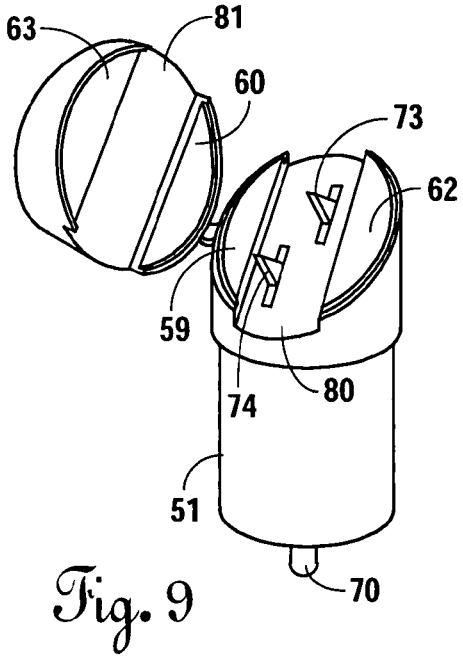
FIG. 9 illustrates an embodiment of a connector housing adapted for an angled rail assembly, such as for the rail and baluster assembly of FIG. 8.

The embodiment shown in FIG. 9 is the similar to the embodiment shown in FIGS. 2-7 except the upper surfaces 80 and 81 are at an angle to the insertion portion for use with angled rail assemblies, such as used on stairs. Because the components are the same, like reference numbers from FIGS. 2-7 are used on FIG. 9.

Figure 10:
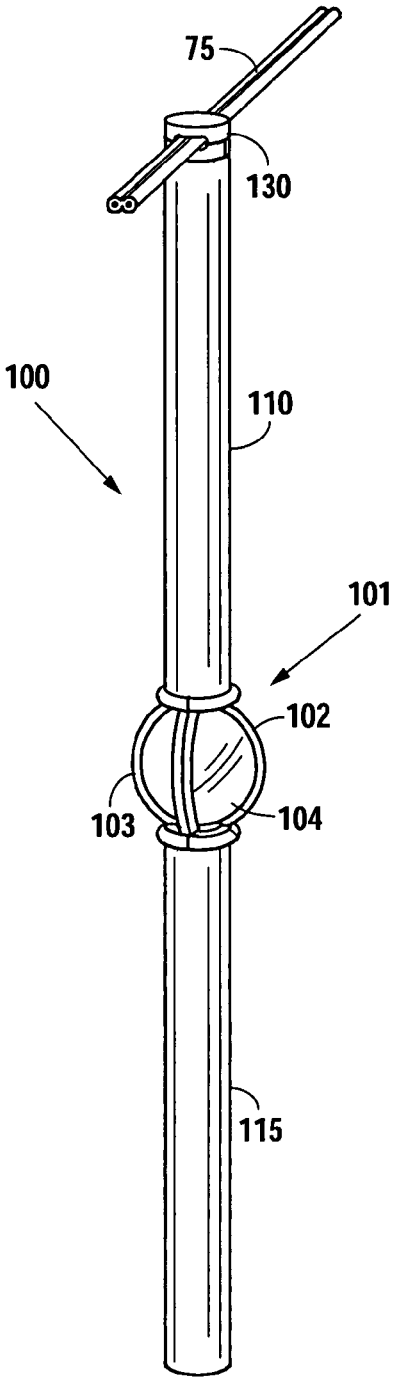
FIG. 10 is a perspective view of one embodiment of a baluster assembly that includes a detachable ornamental connector for connecting separable upper and lower baluster sections.
Figure 11:
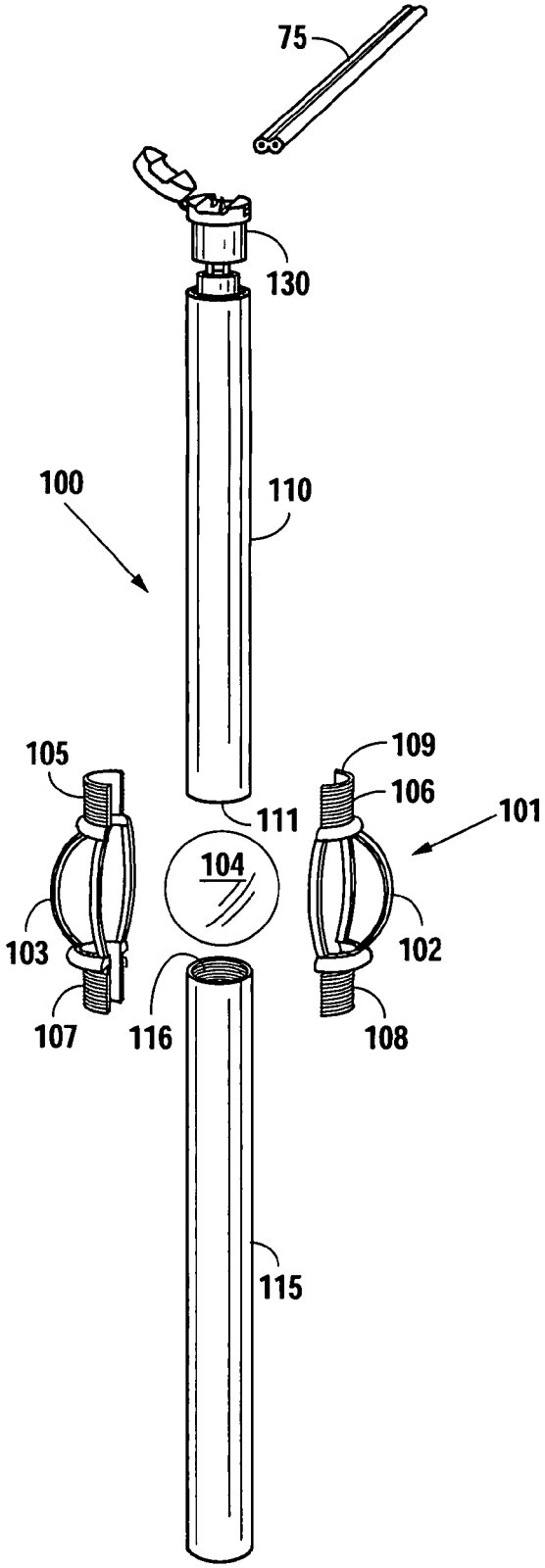
FIG. 11 depicts an exploded, perspective view of the baluster assembly of FIG. 10.

FIGS. 10 and 11 depict perspective and exploded views, respectively, of one embodiment of a baluster assembly 100 that includes a detachable ornamental member 101 connecting separable hollow upper and lower baluster sections 110 and 115. Ornamental member 101 comprises two mating semi-spherical cage portions 102 and 103 sized and shaped to enclose a decorative translucent, light-diffusing piece, such as a glass or plastic sphere 104. Although a smooth round light-diffusing piece is shown, other shapes and designs can be used to give a desired appearance. For instance prisms could be used on the outer surface of the light-diffusing piece. Or if a different shaped light-diffusing piece was desired, this could be accomplished by making the cage portions of the same desired shape as the light-diffusing piece when the light-diffusing piece is a different shape. This way the light-diffusing piece might be oval, square, rectangular or have other multiple flat surfaces. The light-diffusing piece may have portions that are different colors to give another desired appearance. The light-diffusing piece may have objects, symbols or designs embedded in the interior to give another desired appearance.

Externally male connecting portions 105-108 may be threaded and extend upwardly from opposite ends of the cage portions 102 and 103. The upper and lower baluster sections 110 and 115 may be internally threaded at their lower and upper ends 111 and 116, respectively, where they are operable to mate with the outer surface of male connection portions 105-108 which may be externally threaded. Other suitable attaching means may be used for the threaded portions such as glue or adhesive or bonding depending on the type of materials used. When assembled, the upper baluster section 110 holds male connecting portions 105-106 together and the lower baluster section 115 holds male connecting portions 107-108 together, thereby securing the glass sphere 104 between the mated cage portions 102-103.

Male connecting portions 105-108 each take the shape of a hollow cylinder severed along a plane intersecting the cylindrical axis. When assembled, the hollow interior of each male connecting pair 105-106 and 107-108 allows light (or, as explained further below, a portion of a light assembly) to pass therethrough to the glass sphere 104.

Figure 12:
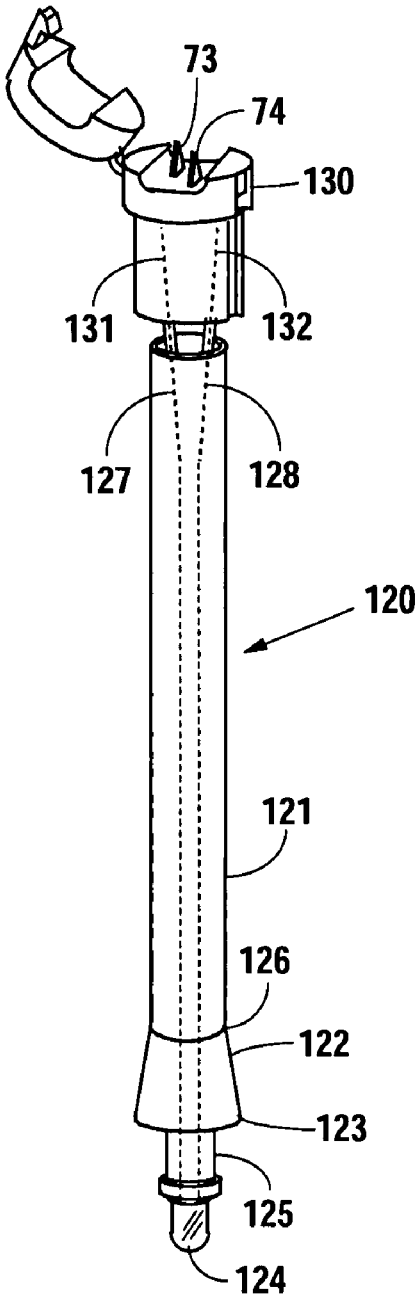
FIG. 12 is a perspective view of an LED rod assembly adapted to be inserted into the passageway of a hollow baluster section and sized to extend along substantially the entire length of the passageway, from a connector housing inserted into the passageway to a lower end portion of the baluster section.

FIG. 12 is a perspective view of a light rod assembly 120 adapted to be inserted into the passageway 112 or 117 (FIG. 13) of a hollow baluster section 110 or 115. Light rod assembly 120 comprises a long rod 121, a flared end section 122, a light mount 125, and a light 124. Flared end section 122 increases in diameter from its narrow end 126, where it is joined to the long rod 121, to its wide end 123. A light mount 125 seating a light source 124, preferably a light emitting diode, protrudes out from under the wide end 123 of the flared section 122. Rod 121 is preferably hollow and encloses two power supply wires 127, 128 for supplying power to the light 124.

FIG. 12 is a perspective view of the light rod assembly 120 of FIG. 12 connected to another embodiment of a connector housing 130. Connector housing 130 is like the connector housing 50 of FIGS. 2-7, except that instead of enclosing an LED, connector housing 130 encloses lead wires 131, 132 electrically connected to pierce connectors 73 and 74. Means for connecting lead wires 131, 132 to supply wires 127, 128—such as cable connectors, edge connectors, pin and socket connectors, snap connectors, or alligator clips—are provided on the connector housing 130 and/or rod assembly 120.

Figure 13:
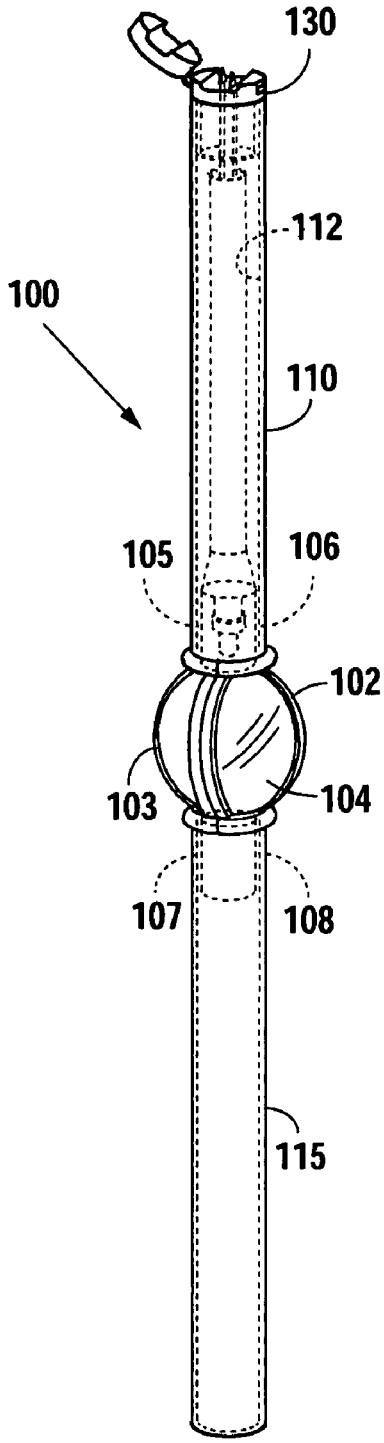
FIG. 13 is a perspective view of the LED rod assembly and connector housing of FIG. 12 inside the baluster assembly of FIG. 11.

FIG. 13 is a perspective view of the light rod assembly 120 and connector housing 130 of FIG. 12 inside the baluster or picket assembly 100 of FIGS. 10-11. As seen in FIG. 13, light rod assembly 120 is sized to extend along substantially the entire length of the passageway 112, from the connector housing 130 (which is also inserted into passageway 112) to a lower end portion 111 of the baluster or picket section 110. When assembled, the wide end 123 of the flared section 122 of the light rod assembly 120 comes into contact with a top edge 109 of the male connecting portions 105-106. The protruding light mount 125 and light source 124 protrude into the hollow interior of male connecting pair, in close proximity to the glass sphere 104 being illuminated.

The method comprises positioning a baluster including an intermediate baluster diffuser member located in a midsection of the baluster between the lower and upper rails. When attached to a power source the light source is projected in each baluster in a manner that directs light toward an intermediate baluster diffuser member so that each intermediate baluster diffuser member widely scatters or diffuses the channeled light away from the baluster. The light may be projected though the baluster to diffuser member between an upper baluster section and a lower baluster section by channeling light through a channel in the baluster from a light source mounted inside the baluster to the light-diffusing member. When the light is projected through the length of one of the hollow baluster section the light is channeled through a reflective surface of a hollow passageway inside the baluster section from a light source mounted inside the baluster to the light-diffusing glass sphere.

Or the light source is positioned adjacent the diffuser to project the light source adjacent the illuminating glass sphere baluster diffuser member. This is accomplished by positioning a light rod assembly that includes the light source that is operable to be inserted into either or both of the upper or lower baluster sections. The light rod assembly is connected to a corresponding connector housing mounted at one end of either the upper or lower baluster section. The light rod assembly is then extended substantially all the way from the connector housing to an opposite end of one of the baluster sections in close proximity to the light-diffusing piece. The connector housing is attached to each baluster to each baluster and the insulation of the insulated power cable is pierced to establish an electrical connection along any selected location of the insulated power cable with pierce connectors in the connector housing to connect the power source to a corresponding light source. Each baluster is preferably illuminated with a light emitting diode light source that gives better illumination than a standard light source.

The connector housings and light rod assemblies shown above can also be inserted into hollow fence pickets and adapted to illuminate decorative pieces, such as a cast glass piece, mounted on the top ends of a row of fence pickets. When the connector housings and light rod assemblies are inserted into balusters or pickets they will provide light at the center of the baluster or picket.

Before concluding, it is to be understood that the terminology employed in this application is for the purpose of describing particular embodiments. Unless the context clearly demonstrates otherwise, it is not intended to be limiting. In this specification and the appended claims, the singular forms "a," "an" and "the" include plural references unless the context clearly dictates otherwise. Conversely, it is contemplated that the claims may be drafted to exclude any optional element or be further limited using exclusive terminology as "solely," "only" and the like in connection with the recitation of claim elements or by use of a "negative" limitation. It is also contemplated that any optional feature of the inventive variations described herein may be set forth and claimed independently, or in combination with any one or more of the features described herein.

Although the foregoing specific details describe various embodiments of the invention, persons reasonably skilled in the art will recognize that various changes may be made in the details of the apparatus of this invention without departing from the spirit and scope of the invention as defined in the appended claims. Therefore, it should be understood that, unless otherwise specified, this invention is not to be limited to the specific details shown and described herein.

I claim:

1. A baluster light assembly comprising:

a plurality of positionable balusters or pickets, each having an intermediate baluster member located in a midsection of the baluster;

a plurality of light sources mounted in each of the balusters or pickets in a manner that channels light toward the intermediate baluster member;

an insulated power cable operable to be strung between the balusters or pickets to supply power to the light sources;

a plurality of power tap connectors adapted to be mounted to one of the ends of each of the balusters or pickets, each power tap connector having:

a base member;

a cap member operable to mate with the base member;

pierce connectors mounted in the base member operable to pierce the insulation of the insulated power cable along any selected location of the insulated power cable; and wherein the base member and cap member are sized, spaced, and configured to press-fit the insulated power cable onto the pierce connectors and to tightly enclose the insulated power cable along any selected location of the power cable; and wires connecting the pierce connectors of each connector housing to a corresponding light source.

2. The baluster lighting assembly of claim 1, wherein the cap member is hingedly connected to the base member.

3. A balustrade light assembly comprising:

a plurality of positionable balusters with an upper end adapted for attachment to an upper rail and a lower end adapted for attachment to a lower rail;

each baluster including an interior passageway extending vertically from the upper or lower end;

a plurality of light sources mounted in the interior passageway of the balusters;

an insulated power cable operable to be strung along the upper and lower rail to and between each baluster to supply power to each light source; and power tap connectors for each baluster, each power tap connector:

(a) being adapted to be mounted to the upper or lower rail;

(b) being adapted to securely mount and electrically tap the insulated power cable; and (c) having an insertion portion sized to securely but removably mount the insertion portion of the connector into the interior passageway of the baluster.

4. The balustrade lighting assembly of claim 3, further comprising for each baluster:

an upper baluster section;

a lower baluster section;

a light-scattering or light-diffusing intermediate baluster member located in a midsection of the baluster;

a central portion connecting the upper baluster section to the lower baluster section and encompassing the light-scattering or light-diffusing intermediate baluster member; and a channel for channeling light from a light source mounted inside the baluster to the light-scattering or light-diffusing intermediate baluster member.

5. The balustrade lighting assembly of claim 4, wherein the intermediate baluster member comprises a glass sphere.

6. The balustrade lighting assembly of claim 4, wherein the channel comprises a reflective surface of a hollow passageway inside the upper or lower baluster section.

7. The balustrade lighting assembly of claim 4, further comprising, for each baluster, a light rod assembly that includes the light source, that is operable to be inserted into the upper or lower baluster section, that is operable to connect to a corresponding power tap connector mounted at one end of the upper or lower baluster section, and that is operable to extend substantially all the way from the power tap connector to an opposite end of the upper or lower baluster section, in close proximity to the light-diffusing piece.

8. The balustrade lighting assembly of claim 3, wherein the power tap connectors further comprise:

pierce connectors operable to pierce the insulation of the insulated power cable along any selected location of the insulated power cable; and wires connecting the pierce connectors of each connector housing to a corresponding light source.

9. The balustrade lighting assembly of claim 8, wherein the insertion portion is sized and shaped to be press-fitted into a corresponding hollow baluster section.

10. The balustrade lighting assembly of claim 9, wherein the light source comprises a light emitting diode protruding out of the insertion portion.

11. The balustrade lighting assembly of claim 10, wherein the insertion portion is molded around the wires connecting the light emitting diode to the pierce connectors.

12. The balustrade lighting assembly of claim 9, wherein the insulated power cable is a ribbon cable.

13. The balustrade lighting assembly of claim 8, wherein each power tap connector comprises a base member and a cap member.

14. The balustrade lighting assembly of claim 13, wherein the cap member is hingedly connected to the base member.

15. The balustrade lighting assembly of claim 13, wherein the base member and cap member are sized, spaced, and configured to press-fit the insulated power cable onto the pierce connectors and to tightly enclose the insulated power cable along any selected location of the power cable.

16. A baluster light assembly comprising:

a plurality of positionable balusters, each baluster including a hollow section;

a plurality of light sources mounted in the hollow sections;

an insulated power cable operable to be strung between the balusters to supply power to the light sources;

a plurality of power tap connectors adapted to be mounted to an end of each of the balusters, each power tap connector including pierce connectors operable to pierce the insulation of the insulated power cable along any selected location of the insulated power cable; and wires connecting the pierce connectors of each connector housing to a corresponding light source.

17. The baluster lighting assembly of claim 16, wherein the insulated power cable is a ribbon cable.

18. The baluster lighting assembly of claim 16, wherein each power tap connector comprises a base member and a cap member.

19. The baluster lighting assembly of claim 18, wherein the cap member is hingedly connected to the base member.

20. The baluster lighting assembly of claim 18, wherein the base member and cap member are sized, spaced, and configured to press-fit the insulated power cable onto the pierce connectors and to tightly enclose the insulated power cable along any selected location of the power cable.

21. A method of lighting a positionable baluster comprising the steps of:

connecting a power tap connector to an upper or lower balustrade rail;

mounting an insulated power cable into the power tap connector;

connecting the power tap connector to a light source;

inserting the light source into a vertical passageway of the baluster, and mounting the power tap connector to the end of the baluster, wherein the vertical passageway is configured to channel light toward an intermediate baluster member so that widely scatters or diffuses channeled light away from the baluster; and supplying power through the insulated power cable to the baluster to supply power to the light source.

22. The method of claim 21 of lighting a baluster, the method further comprising the step of:

mounting the intermediate baluster member between an upper baluster section and a lower baluster section of the baluster.

23. The method of claim 21 of lighting a baluster, wherein the intermediate baluster member comprises: and glass sphere.

24. The method of claim 21 of lighting a baluster, wherein the vertical passageway of the baluster has a reflective surface to channel light from a light source mounted inside the baluster to the intermediate baluster member.

25. The method of claim 21 of lighting a baluster, the method further comprising the steps of:

inserting a light rod assembly that includes the light source into the vertical passageway; and connecting the light rod assembly to the power tap connector;

wherein the light rod assembly extends substantially all the way from the connector housing to an opposite end of one of the baluster sections in close proximity to the intermediate baluster member.

26. The method of claim 21 of lighting a baluster, the method further comprising the step of:

piercing the insulation of the insulated power cable along any selected location of the insulated power cable with pierce connectors in the power tap connector.

27. The method of claim 26 of lighting a baluster, the method further comprising the step of:

press fitting the power tap connector into a corresponding hollow baluster section.

28. The method of claim 26 of lighting a baluster, wherein the power tap connector has an insertion portion that is molded around wires connecting a light emitting diode to pierce connectors in the power tap connector.

29. The method of claim 21 of lighting a baluster, wherein the light source comprises a light emitting diode.

* * * * *